US009550275B2

(12) United States Patent
Chiba et al.

(10) Patent No.: US 9,550,275 B2
(45) Date of Patent: Jan. 24, 2017

(54) DISC-SHAPED GRINDSTONE

(71) Applicant: HONDA MOTOR CO., LTD., Tokyo (JP)

(72) Inventors: Daisuke Chiba, Tochigi (JP); Tadatomo Hatayama, Tochigi (JP); Masakazu Okayasu, Tochigi (JP); Satoshi Kaneko, Tochigi (JP); Masayuki Kinoshita, Tochigi (JP); Hiroshi Kunieda, Tochigi (JP); Munehiko Higuchi, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/832,090

(22) Filed: Aug. 21, 2015

(65) Prior Publication Data

US 2016/0059387 A1 Mar. 3, 2016

(30) Foreign Application Priority Data

Aug. 29, 2014 (JP) ..... 2014-175323

(51) Int. Cl.
*B24B 7/06* (2006.01)
*B24D 7/06* (2006.01)
*B24D 7/18* (2006.01)

(52) U.S. Cl.
CPC ..... *B24D 7/066* (2013.01); *B24D 7/18* (2013.01)

(58) Field of Classification Search
CPC ..... B24D 7/066; B24D 7/18
USPC ..... 451/542, 547, 443, 56, 540
See application file for complete search history.

(56) References Cited

U.S. PATENT DOCUMENTS 3,324,607 A * 6/1967 Niemiec ..... B24D 5/06 451/488
3,376,673 A * 4/1968 Metzger ..... A47B 67/02 451/342
3,951,619 A * 4/1976 Frangipane ..... B24D 18/00 451/542
4,490,158 A * 12/1984 Kuromatsu ..... B23H 5/08 204/290.01
5,052,154 A * 10/1991 Lehmann ..... B24D 7/18 451/542
5,707,278 A * 1/1998 Korn ..... B24D 13/10 300/21
5,725,416 A * 3/1998 Russell ..... B24D 5/06 241/293

(Continued)

FOREIGN PATENT DOCUMENTS

DE 4012624 C1 * 10/1991 ..... B24D 9/02
JP 11-207576 8/1999

*Primary Examiner* — George Nguyen
(74) *Attorney, Agent, or Firm* — Rankin, Hill & Clark LLP

(57) ABSTRACT

A disc-shaped grindstone 1 includes a plurality of split grindstones provided in an outer circumferential surface of a disc-shaped base 3. At least a part of the split grindstones include a moving grindstone 6 which is movable in the axial direction of the disc-shaped base 3. Since a part of the split grindstones 4 is the moving grindstone 6 which is movable in the axial direction, the width of the disc-shaped grindstone 1 may be changed in a manner such that the moving grindstone 6 is moved in the axial direction. Accordingly, it is possible to promptly handle a plurality of kinds of grinding targets without replacing the disc-shaped grindstone 1.

7 Claims, 11 Drawing Sheets

(56) References Cited

U.S. PATENT DOCUMENTS

| | | | | |
|---|---|---|---|---|
| 6,283,845 | B1 * | 9/2001 | Fischbacher | B24B 55/02 451/542 |
| 6,564,887 | B2 * | 5/2003 | Hong | B28D 1/041 175/395 |
| 7,235,007 | B2 * | 6/2007 | Junker | B24D 7/18 451/449 |
| 7,695,353 | B2 * | 4/2010 | Moroto | B24D 5/14 451/541 |
| 8,197,305 | B2 * | 6/2012 | Ido | B24D 5/10 451/449 |
| 2016/0059387 | A1 * | 3/2016 | Chiba | B24D 7/18 451/542 |

* cited by examiner

DISC-SHAPED GRINDSTONE

BACKGROUND OF THE INVENTION

Field of the Invention

The present invention relates to a disc-shaped grindstone which is used to grind, for example, a shaft object such as a crank shaft.

Description of the Related Art

Hitherto, there is known a disc-shaped grindstone used to grind a pin portion and a journal portion of a crank shaft (for example, see Japanese Patent Publication No. 11-207576 A). The disc-shaped grindstone grinds a shaft object such as a crank shaft by the outer circumferential surface thereof in a rotation state.

SUMMARY OF THE INVENTION

When a plurality of kinds of grinding targets is ground in the same grinding process line, a specification of a shaft object changes whenever a grinding type changes. Thus, there is a case where the disc-shaped grindstone used for the grinding operation needs to be also replaced. However, the disc-shaped grindstone is comparatively heavy, and the replacement operation requires auxiliary equipment or the like. For this reason, the replacement operation is troublesome. Further, since there is a need to perform a balance adjusting operation or a dressing operation for the disc-shaped grindstone even after the disc-shaped grindstone is attached to a grinding machine, much time needs to be spent whenever the grinding type changes.

The invention is made in view of the above-described circumstances, and an object thereof is to provide a disc-shaped grindstone capable of handling a plurality of kinds of grinding targets without any replacement.

[1] In order to attain the above-described object, according to an aspect of the invention, provided is a disc-shaped grindstone in which a plurality of split grindstones is provided in an outer circumferential surface of a disc-shaped base, wherein the split grindstones include a moving grindstone which is movable in an axial direction of the disc-shaped base, wherein a corner portion in the axial direction of each split grindstone is formed in a curved surface shape, wherein a split grindstone which is fixed to the disc-shaped base so as not to be movable in the axial direction among the split grindstones is defined as a fixed grindstone, and wherein the moving grindstone and the fixed grindstone are formed so that a curvature radiuses of the corner portions in the axial direction are different from each other.

According to the aspect of the invention, since a part of the split grindstones are the moving grindstones which are movable in the axial direction, the width of the disc-shaped grindstone may be changed in a manner such that the moving grindstones are moved in the axial direction. Thus, according to the disc-shaped grindstone of the aspect of the invention, it is possible to promptly handle a plurality of kinds of grinding targets without any replacement.

Further, in the aspect of the invention, the corner portion in the axial direction of the split grindstone is formed in a curved surface shape, the split grindstone which is fixed to the disc-shaped base so as not to be movable in the axial direction among the split grindstones is defined as the fixed grindstone, and the moving grindstone and the fixed grindstone are formed so that the curvature radiuses of the corner portions in the axial direction are different from each other. According to such a configuration, it is possible to handle different kinds of grinding targets having corner portions required with different curvature radiuses.

[2] Further, in the aspect of the invention, the split grindstone may be split in the circumferential direction of the disc-shaped base. A configuration may be considered in which the split grindstone is split in the axial direction of the disc-shaped base. However, when the moving grindstone is moved in the axial direction in a case where the split grindstone is split in the axial direction, a gap is formed therebetween in the axial direction, and hence a center portion may not be ground. When the split grindstone is split in the circumferential direction of the disc-shaped base, an overlap portion may be provided between the split grindstones even when the width of the disc-shaped grindstone is changed by the movement of the moving grindstone, and hence the grinding operation may be appropriately performed.

[3] Further, in the aspect of the invention, a plurality of the moving grindstones may be provided so as to be adjacent to each other in the axial direction, and an axial end surface of the moving grindstone may be an inclined surface which is inclined in the axial direction of the disc-shaped base. According to such a configuration, even when a gap is formed between the moving grindstones adjacent to each other in the axial direction by the movement of the moving grindstones, it is possible to suppress degradation in grinding efficiency caused by the gap.

[4] Further, in the aspect of the invention, a plurality of the moving grindstones may be provided in the circumferential direction, and split surfaces of the moving grindstones may be deviated from each other. According to such a configuration, even when a gap is formed by the movement of the moving grindstones, a position where the gap is formed is dispersed. Thus, it is possible to suppress degradation in grinding efficiency caused by the gap.

[5] Further, in the aspect of the invention, the moving grindstones may include two split grind stones which are split into two parts in the axial direction and three split grindstones which are split into three parts in the axial direction. According to such a configuration, even when a gap is formed by the movement of the moving grindstones, a position where the gap is formed is dispersed. Thus, it is possible to suppress degradation in grinding efficiency caused by the gap.

[6] Further, in the aspect of the invention, an adjustment screw may be provided so as to adjust a movement amount in the axial direction of the moving grindstone.

[7] Further, in the aspect of the invention, the fixed grindstone may have a plate shape, the moving grindstone may include a pair of movable plates which sandwiches the plate-shaped fixed grindstone in the axial direction, a tapered portion of which a thickness gradually changes in the circumferential direction may be provided between the fixed grindstone and the movable plate, and the width in the axial direction of the disc-shaped grindstone may be changed in a manner such that the fixed grindstone and the movable plate are rotated relatively so as to change a gap between the pair of movable plates by the tapered portion.

DETAILED DESCRIPTION OF THE PREFERRED EMBODIMENTS

First Embodiment

Figure 1:
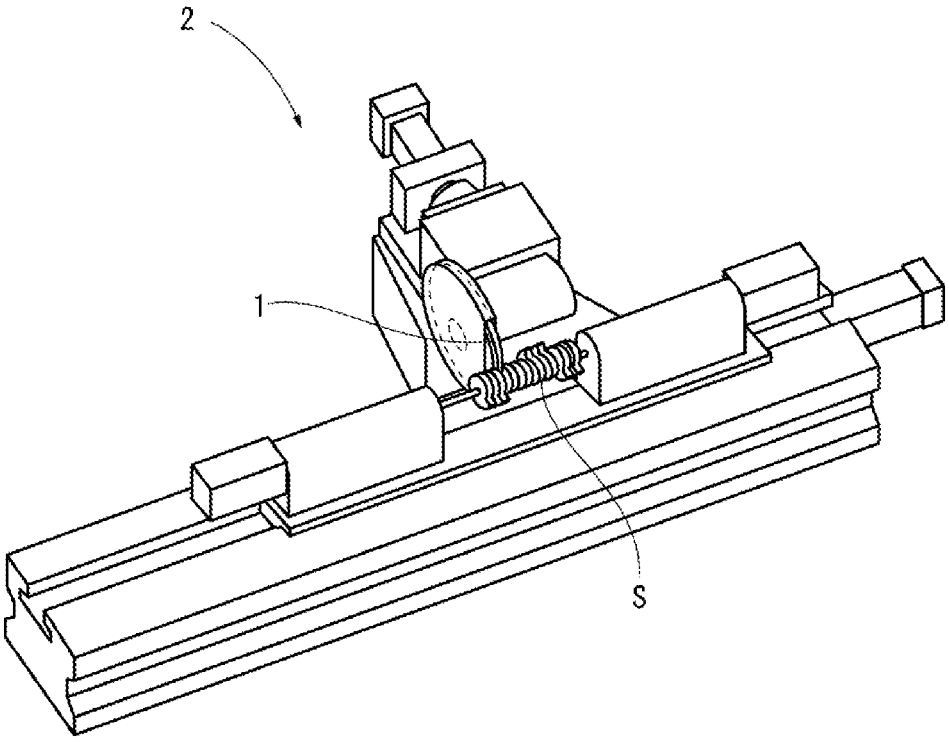
FIG. 1 is a perspective view illustrating a grinding machine which uses a disc-shaped grindstone of a first embodiment of the invention.

FIG. 1 illustrates a grinding machine 2 which uses a disc-shaped grindstone 1 of a first embodiment of the invention. The grinding machine 2 is used to grind a pin portion of a crank shaft S as a shaft object.

Figure 2:
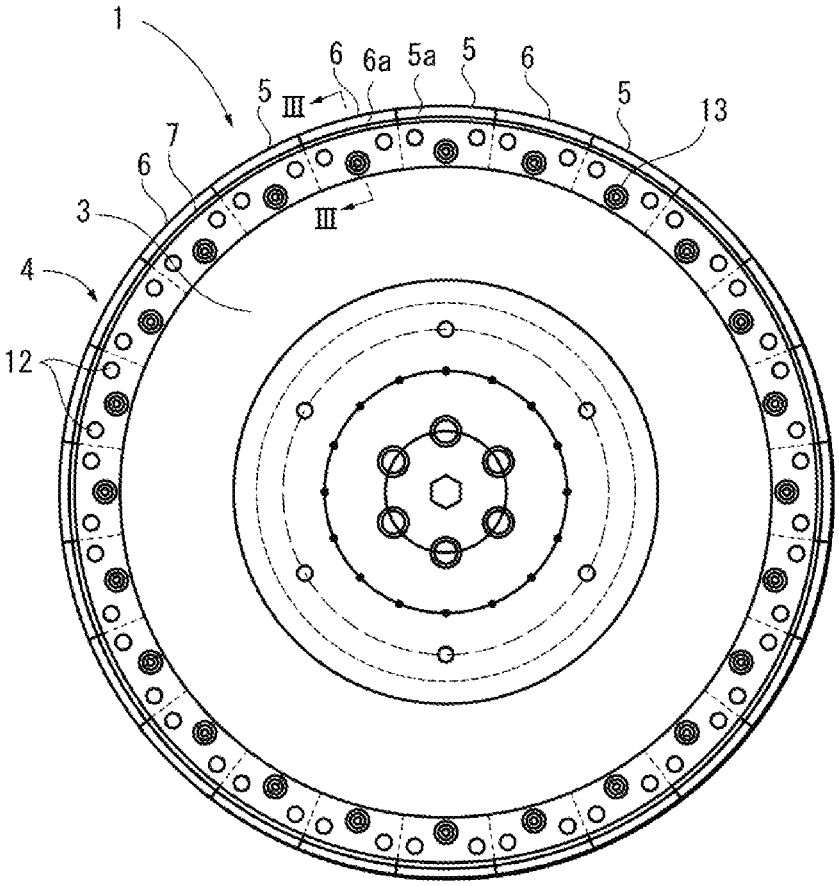
FIG. 2 is a diagram illustrating the disc-shaped grindstone of the first embodiment.

FIG. 2 illustrates the disc-shaped grindstone 1 of the first embodiment. The disc-shaped grindstone 1 of the first embodiment includes a disc-shaped base 3 and split grindstones 4 which are provided in the outer circumferential surface of the disc-shaped base 3. The split grindstones 4 include a fixed grindstone 5 which is immovably fixed to the disc-shaped base 3 and a moving grindstone 6 movable in the axial direction with respect to the disc-shaped base 3. The fixed grindstone 5 and the moving grindstone 6 are alternately arranged in the circumferential direction of the disc-shaped base 3. The disc-shaped grindstone 1 is formed so that the curvature radius of a corner portion 5*a* of the fixed grindstone 5 is smaller than the curvature radius of a corner portion 6*a* of the moving grindstone 6.

Figure 3A:
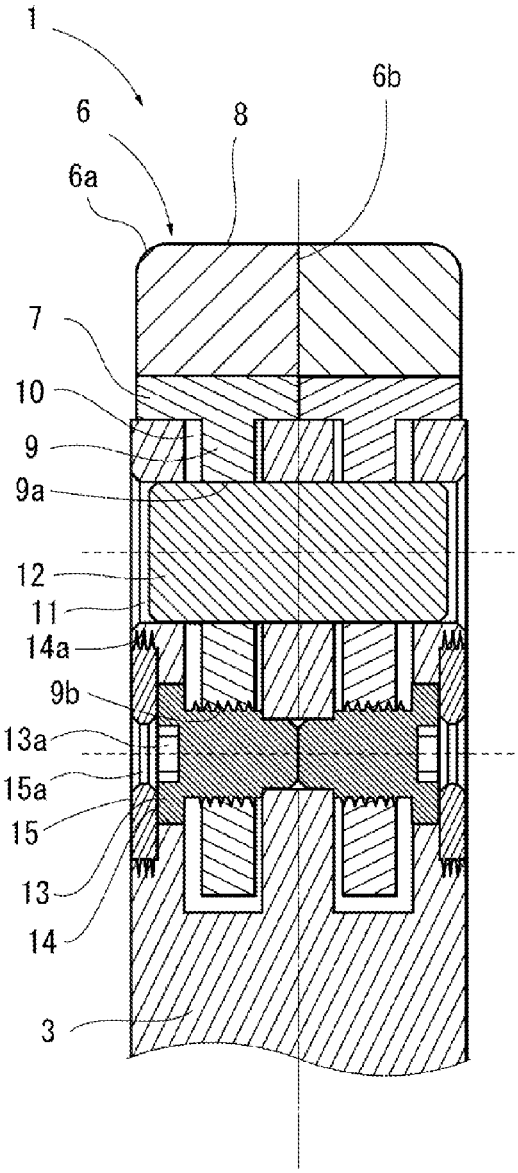
FIG. 3A is a cross-sectional view illustrating a state where the width of the disc-shaped grindstone of the first embodiment is narrow.
Figure 3B:
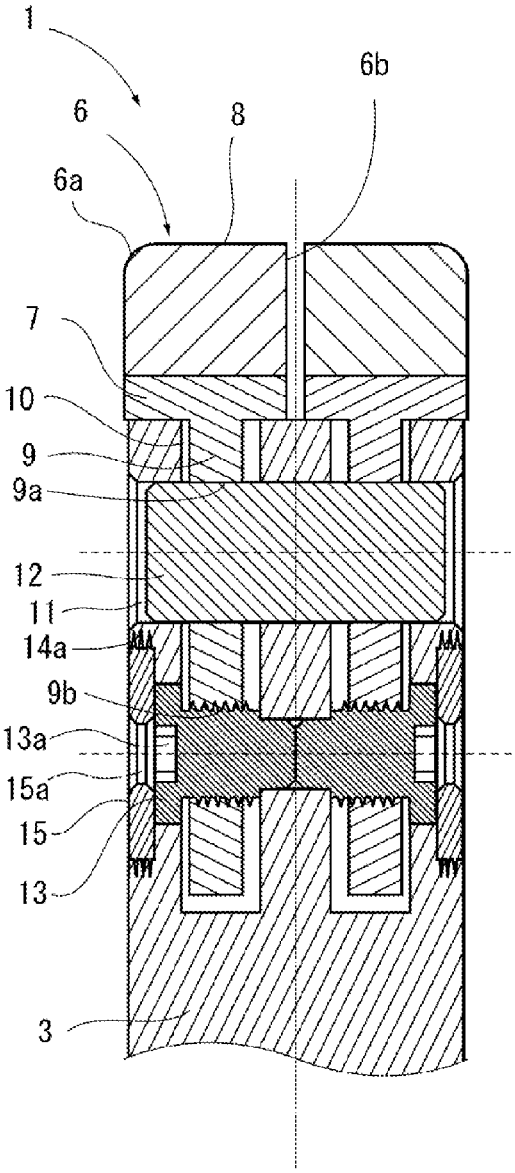
FIG. 3B is a cross-sectional view illustrating a state where a moving grindstone moves so that the width of the disc-shaped grindstone is widened.

As illustrated in FIGS. 3A and 3B, the moving grindstone 6 includes a pair of moving bases 7 which is arranged in the axial direction of the disc-shaped base 3 and a grindstone body 8 which is bonded to the outer surface of each moving base 7. The moving base 7 is provided with a protrusion 9 which extends toward the disc-shaped base 3. The outer circumferential surface of the disc-shaped base 3 is provided with a receiving hole 10 which receives the protrusion 9.

A penetration hole 11 is formed so as to penetrate the disc-shaped base 3 across the receiving hole 10 in the axial direction. The protrusion 9 is provided with a penetration hole 9*a* which penetrates the protrusion 9 in the axial direction so as to correspond to the penetration hole 11. The penetration hole 9*a* of the protrusion 9 is formed so that the diameter is slightly larger than that of the penetration hole 11 of the disc-shaped base 3. A guide pin 12 is press-inserted into the penetration hole 11 of the disc-shaped base 3 through the penetration hole 9*a* of the protrusion 9.

The moving grindstone 6 is movable along the guide pin 12 in the axial direction of the disc-shaped base 3. Further, two guide pins 12 are provided in each moving grindstone 6 while being separated from each other in the circumferential direction of the disc-shaped base 3.

The protrusion 9 of the moving base 7 is provided with a screw hole 9*b* which is located between two penetration holes 9*a* into which two guide pins 12 are respectively inserted. An adjustment screw 13 having a hexagonal hole 13*a* formed at the head portion thereof is threaded into the screw hole 9*b*.

The disc-shaped base 3 is provided with a receiving portion 14 which receives the adjustment screw 13. The opening end of the receiving portion 14 is provided with a female screw 14*a*. A donut-shaped male screw 15 which prohibits the movement of the adjustment screw 13 in the axial direction is threaded into the female screw 14*a* of the receiving portion 14.

When a hexagonal wrench (not illustrated) engages with the hexagonal hole 13*a* through a center hole 15*a* of the donut-shaped male screw 15 so as to rotate the adjustment screw 13, the moving grindstone 6 moves along the guide pin 12 in the axial direction of the disc-shaped base 3. FIG. 3A illustrates a state where the moving grindstones 6 which are adjacent to each other in the axial direction contact each other so that the width of the disc-shaped grindstone 1 is the narrowest. FIG. 3B illustrates a state where the moving grindstones 6 which are adjacent to each other in the axial direction are most separated from each other so that the width of the disc-shaped grindstone 1 is the widest.

According to the disc-shaped grindstone 1 of the first embodiment, since a part of the split grindstones 4 are the moving grindstones 6 which are movable in the axial direction, the width of the disc-shaped grindstone 1 may be changed in a manner such that the moving grindstones 6 are moved in the axial direction. Accordingly, according to the disc-shaped grindstone 1 of the first embodiment, it is possible to promptly handle a plurality of kinds of crank shafts S (grinding targets) without any replacement.

Further, in the disc-shaped grindstone 1 of the first embodiment, the split grindstones 4 are split in the circumferential direction of the disc-shaped base 3. Then, the fixed grindstone 5 and the moving grindstone 6 are alternately arranged in the circumferential direction. Accordingly, when the pair of moving grindstone 6 arranged in the axial direction is moved so as to be separated from each other in the axial direction, a gap is formed at the center portion between the moving grindstones 6. However, the center portion may be also appropriately ground by the fixed grindstones 5 which are adjacent in the circumferential direction. Accordingly, even when the moving grindstones 6 are moved so as to change the width of the disc-shaped grindstone 1, an overlapping portion may be formed between the split grindstones 4, and hence the grinding operation may be appropriately performed.

Further, in the disc-shaped grindstone 1 of the first embodiment, a case has been described in which the fixed grindstone 5 and the moving grindstone 6 are alternately arranged on the outer circumference of the disc-shaped base 3. However, the entire outer circumference of the disc-shaped base 3 may be covered by the moving grindstones. In this case, the width of the disc-shaped grindstone 1 may be adjusted in a manner such that the moving grindstones in the circumferential direction are alternately moved in the axial direction.

Further, in the first embodiment, a case has been described in which the moving base 7 is also split for each moving grindstone 6. However, the moving grindstone 6 of the invention is not limited thereto. For example, a configuration may be employed in which an annular connection portion is provided so as to connect all moving bases 7 at the inside in the radial direction and an adjustment screw is threaded into the annular connection portion so that the plurality of moving grindstones 6 arranged in the circumferential direction are moved by performing the operation of the adjustment screw only once.

Further, in the first embodiment, a case has been described in which the adjustment screw 13 located at one side in the axial direction is adjusted from one side and the adjustment screw 13 located at the other side in the axial direction is adjusted from the other side. However, the adjustment screw of the invention is not limited thereto. For example, a configuration may be employed in which the movement amount of the moving grindstones 6 which are adjacent to each other in the axial direction is adjusted from the same axial direction. In this case, for example, a configuration may be employed in which the adjustment screw arrangement positions at one side and the other side are deviated from each other in the circumferential direction and a window hole is provided at the user-side protrusion 9 so as to adjust the adjustment screw in the farther side.

Second Embodiment

Figure 4A:
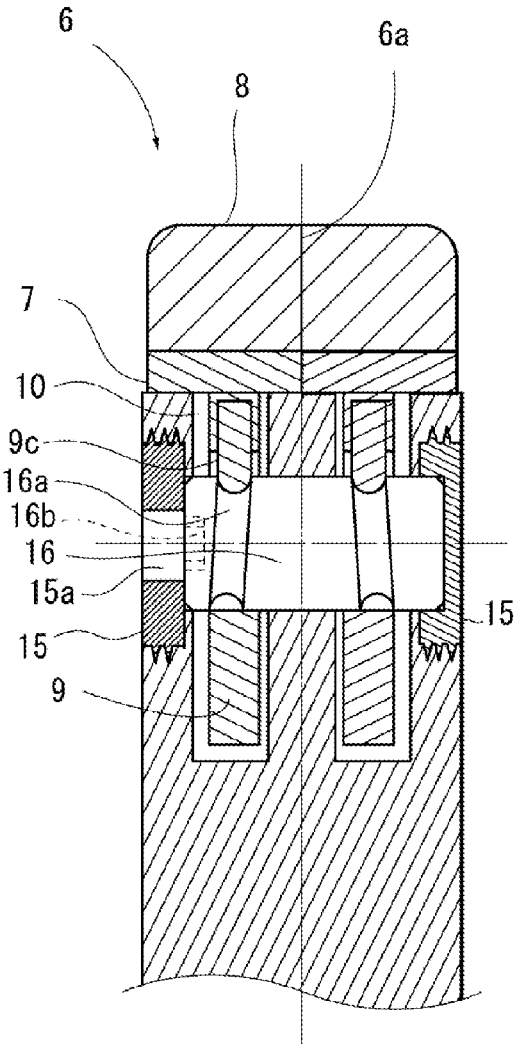
FIG. 4A is a cross-sectional view illustrating a state where the width of a disc-shaped grindstone of a second embodiment of the invention is narrow.
Figure 4B:
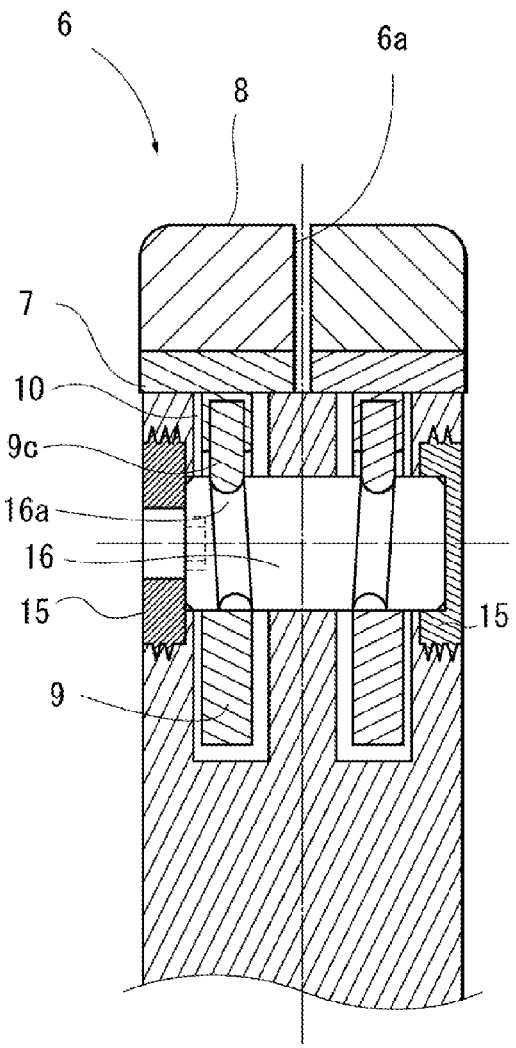
FIG. 4B is a cross-sectional view illustrating a state where the width of the disc-shaped grindstone of the second embodiment is wide.
Figure 5A:
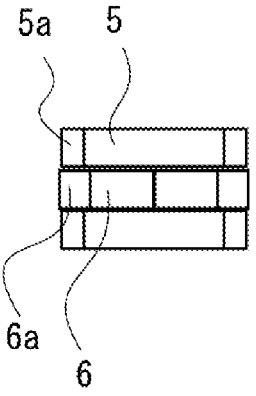
FIG. 5A is a diagram schematically illustrating a part of a disc-shaped grindstone of a third embodiment of the invention when viewed from the radial direction.
Figure 5C:
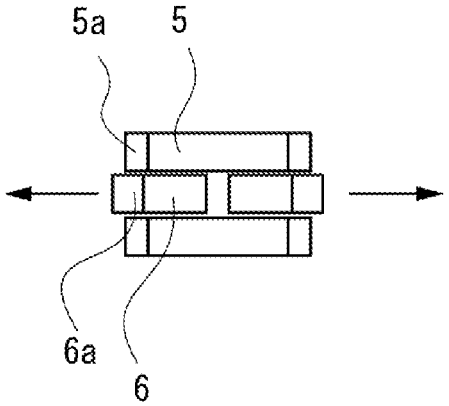
FIG. 5C is a diagram schematically illustrating a state where the width of the disc-shaped grindstone of the third embodiment is wide.
Figure 5B:
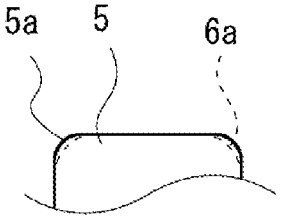
FIG. 5B is a cross-sectional view schematically illustrating the disc-shaped grindstone of FIG. 5A when viewed from the circumferential direction.
Figure 5D:
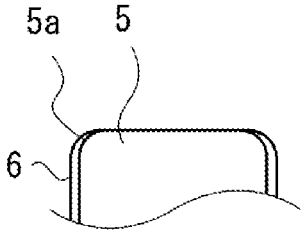
FIG. 5D is a cross-sectional view schematically illustrating the disc-shaped grindstone of FIG. 5C when viewed from the circumferential direction.

Referring to FIGS. 4A and 4B, a disc-shaped grindstone 1 of a second embodiment will be described. The disc-shaped grindstone 1 of the second embodiment is different from the disc-shaped grindstone 1 of the first embodiment in that a cam screw 16 having a cam groove 16*a* formed on the outer circumferential surface thereof is provided instead of the adjustment screw 13 and a protrusion 9 of a moving base 7 is provided with an engaging protruding portion 9*c* which engages with the cam groove 16*a* of the cam screw 16 instead of the screw hole 9*b*, but the other configurations are the same.

The outer circumferential surface of the cam screw 16 of the second embodiment is provided with two cam grooves 16*a* which are separated from each other in the axial direction and are symmetric to each other in the axial direction. The engaging protruding portions 9*c* which are respectively provided in the protrusions 9 of two moving grindstones 6 adjacent to each other in the axial direction respectively engage with the two cam grooves 16*a*. One end surface of the cam screw 16 is provided with a hexagonal hole 16*b* which engages with a hexagonal wrench (not illustrated).

According to the disc-shaped grindstone 1 of the second embodiment, the moving grindstones 6 adjacent to each other in the axial direction may be moved simultaneously by the same movement amount just by rotating one cam screw 16 while engaging the hexagonal wrench with the hexagonal hole 16*b*. Thus, the width of the disc-shaped grindstone 1 may be easily adjusted compared to the disc-shaped grindstone 1 of the first embodiment which individually moves the moving grindstones 6 adjacent to each other in the axial direction by the adjustment screw 13.

Third Embodiment

Referring to FIGS. 5A to 5D, a disc-shaped grindstone 1 of a third embodiment will be described. In the disc-shaped grindstone 1 of the third embodiment, the curvature radius of a corner portion 5*a* of a fixed grindstone 5 is set to be smaller than the curvature radius of a corner portion 6*a* of a moving grindstone 6, and the other configurations are the same as those of the first embodiment.

According to the disc-shaped grindstone 1 of the third embodiment, when the moving grindstones 6 adjacent to each other in the axial direction contact each other without moving the moving grindstones 6 in the axial direction, the corner portion 5*a* having a small curvature radius is located at the outermost side in the axial direction. On the contrary, when the moving grindstones 6 are moved in the axial direction so as to widen the width of the disc-shaped grindstone 1, the corner portion 6*a* having a large curvature radius is located at the outermost side in the axial direction. For this reason, it is possible to grind a pin portion of a crank shaft by the corner portion 6*a* having an appropriate curvature radius when the width of the disc-shaped grindstone 1 is widened.

Fourth Embodiment

Figure 6A:
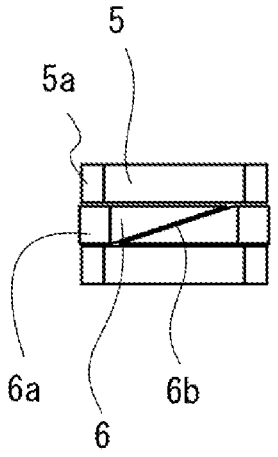
FIG. 6A is a diagram schematically illustrating a part of a disc-shaped grindstone of a fourth embodiment of the invention when viewed from the radial direction.
Figure 6B:
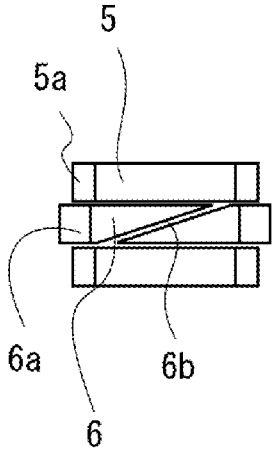
FIG. 6B is a diagram illustrating a state where the width of the disc-shaped grindstone of the fourth embodiment is wide.

Referring to FIGS. 6A and 6B, a disc-shaped grindstone 1 of a fourth embodiment will be described. The disc-shaped grindstone 1 of the fourth embodiment has the same configuration as the disc-shaped grindstone 1 of the third embodiment except that axial end surfaces 6*b* of moving grindstones 6 adjacent to each other in the axial direction are inclined surfaces inclined in the axial direction of a disc-shaped base 3. According to the disc-shaped grindstone 1 of the fourth embodiment, even when the moving grindstones 6 are separated from each other in the axial direction, a gap existence position at the contact position between the disc-shaped grindstone 1 and the crank shaft S (the grinding target) is deviated in the axial direction with the rotation of the disc-shaped grindstone 1 since the adjacent axial end surfaces 6*b* are obliquely inclined. Thus, it is possible to suppress degradation in grinding efficiency caused by the gap compared to a case where the formed gap is continuously located at the same portion in the axial direction as in the first embodiment.

Fifth Embodiment

Figure 7A:
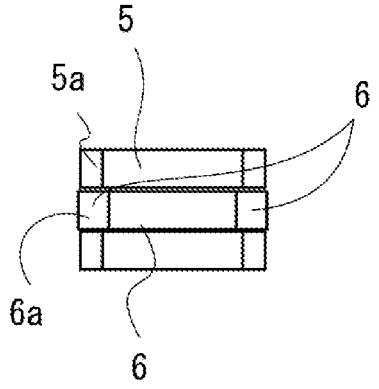
FIG. 7A is a diagram schematically illustrating a part of a disc-shaped grindstone of a fifth embodiment of the invention when viewed from the radial direction.
Figure 7B:
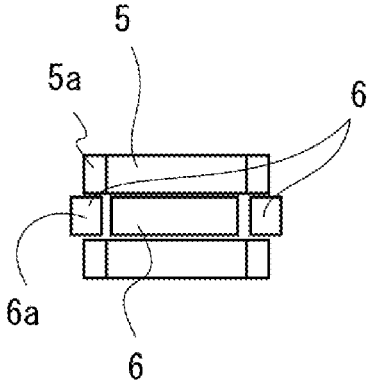
FIG. 7B is a diagram schematically illustrating a state where the width of the disc-shaped grindstone of the fifth embodiment is wide.

Referring to FIGS. 7A and 7B, a disc-shaped grindstone 1 of a fifth embodiment will be described. The disc-shaped grindstone 1 of the fifth embodiment has the same configuration as the disc-shaped grindstone 1 of the third embodiment except that three moving grindstones 6 are provided adjacently in the axial direction. In the disc-shaped grindstone 1 of the fifth embodiment, the width of the disc-shaped grindstone 1 may be widened in a manner such that the moving grindstone 6 located at the outside in the axial direction is moved outward in the axial direction as in the moving grindstone 6 of the first embodiment. Further, since the center moving grindstone 6 does not move actually in the axial direction, the center moving grindstone may be defined as the fixed grindstone 5.

According to the disc-shaped grindstone 1 of the fifth embodiment, since three moving grindstones 6 are adjacent to each other in the axial direction, a gap is formed between the moving grindstones 6 at two positions compared to the first embodiment when the width of the disc-shaped grindstone 1 is widened. Thus, it is possible to decrease the gap between the moving grindstones 6 at each position, and hence to suppress degradation in grinding efficiency.

Further, in the fifth embodiment, two split moving grindstones 6 of the third embodiment may be provided instead of the fixed grindstone 5. According to such a configuration, two split moving grindstones 6 and three split moving grindstones 6 are alternately arranged in the circumferential direction, and the center gap and two split gaps alternately come during the grinding operation. Thus, it is possible to further suppress degradation in grinding efficiency.

Sixth Embodiment

Figure 8A:
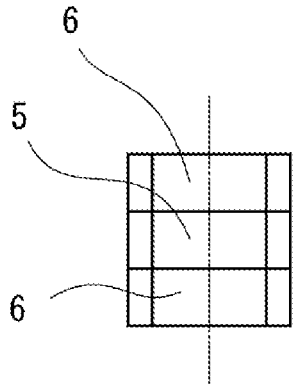
FIG. 8A is a diagram schematically illustrating a part of a disc-shaped grindstone of a sixth embodiment of the invention when viewed from the radial direction.
Figure 8B:
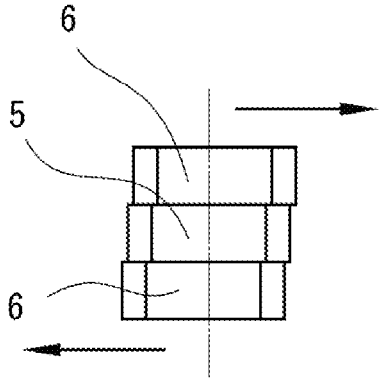
FIG. 8B is a diagram illustrating a state where the width of the disc-shaped grindstone of the sixth embodiment is wide.

Referring to FIGS. 8A and 8B, a disc-shaped grindstone 1 of a sixth embodiment will be described. The disc-shaped grindstone 1 of the sixth embodiment has the same configuration as the first embodiment except that a moving grindstone 6 is not split in the axial direction. In the disc-shaped grindstone 1 of the sixth embodiment, the width of the disc-shaped grindstone 1 is changed in a manner such that the movement directions of the moving grindstones 6 are alternately changed. Even in this configuration, it is possible to promptly handle a plurality of kinds of crank shafts S (grinding targets) without replacing the disc-shaped grindstone 1. Further, since the movement directions of the moving grindstones 6 are alternately different from each other, a portion which is not partially ground is alternately deviated. Thus, it is possible to suppress degradation in grinding efficiency.

Seventh Embodiment

Figure 9:
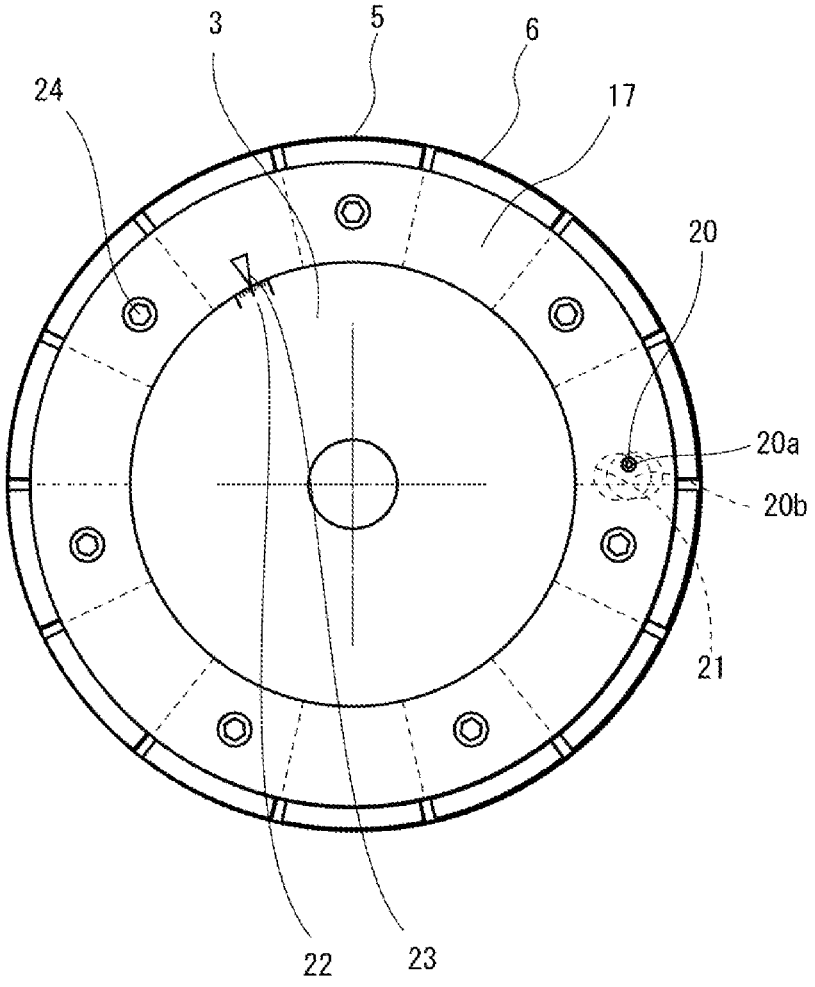
FIG. 9 is a diagram illustrating a disc-shaped grindstone of a seventh embodiment of the invention.

Referring to FIG. 9, a disc-shaped grindstone 1 of a seventh embodiment will be described. Further, in the disc-shaped grindstone 1 of the seventh embodiment, the same reference sign will be given to the same component as the first embodiment, and the description of the component will not be repeated. In the disc-shaped grindstone 1 of the seventh embodiment, moving bases 7 are integrally connected to each other through an annular connection portion 17 at the inside in the radial direction as described in the modified example of the first embodiment.

Figure 10A:
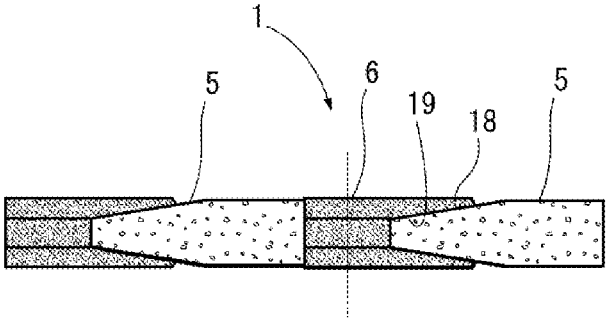
FIG. 10A is a diagram illustrating a state where the width of the disc-shaped grindstone of the seventh embodiment is narrow.
Figure 10B:
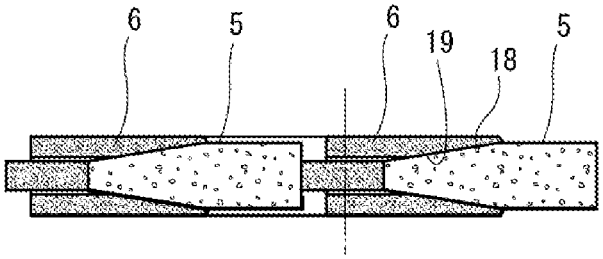
FIG. 10B is a diagram illustrating a state where the width of the disc-shaped grindstone of the seventh embodiment is wide.

As illustrated in FIGS. 10A and 10B, a fixed inclined surface 18 which is inclined so as to be narrowed as it moves close to an adjacent moving grindstone 6 is provided at one side of a fixed grindstone 5 in the circumferential direction. Further, a moving inclined surface 19 which is inclined so as to correspond to the fixed inclined surface 18 of the fixed grindstone 5 is provided at the other side of the moving grindstone 6 in the circumferential direction. In the seventh embodiment, a tapered portion of the invention is formed by the fixed inclined surface 18 and the moving inclined surface 19.

Figure 11:
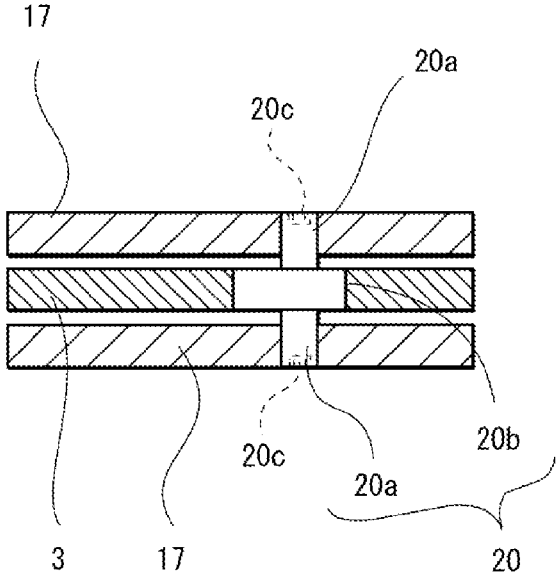
FIG. 11 is a diagram illustrating an operation of a moving grindstone of the seventh embodiment.

As illustrated in FIG. 9, in the disc-shaped grindstone 1 of the seventh embodiment, the movement amount of the moving grindstone 6 in the axial direction is adjusted in a manner such that a cam pin 20 is rotated instead of the adjustment screw. As illustrated in FIG. 11, the cam pin 20 is formed so that a disc-shaped cam body 20*b* located at the center of a rotation shaft 20*a* is in a state eccentric with respect to the rotation shaft 20*a*. A cam hole 21 is perforated in a disc-shaped base 3 having the fixed grindstone 5 fixed thereto so as to correspond to the cam body 20*b*. An end surface of the rotation shaft 20*a* is provided with a hexagonal hole 20*c* which engages with a hexagonal wrench (not illustrated).

FIG. 10A illustrates a state where the width of the disc-shaped grindstone 1 is the narrowest. FIG. 10B illustrates a state where the width of the disc-shaped grindstone 1 is widened in a manner such that the cam pin 20 is rotated from the state of FIG. 10A so that the fixed grindstone 5 enters between the moving grindstones 6 adjacent to each other in the axial direction by the fixed inclined surface 18 and the moving inclined surface 19.

Further, as illustrated in FIG. 9, a scale 22 is marked in the disc-shaped base 3, and the annular connection portion 17 is provided with an arrow 23 corresponding to the scale 22. Accordingly, it is possible to read the width of the current disc-shaped grindstone 1 without measuring the actual width of the disc-shaped grindstone 1. Further, in the disc-shaped grindstone 1 of the seventh embodiment, a fixed bolt 24 is provided so as to be inserted through the disc-shaped base 3 and the moving base 7 in a penetrating manner. When a nut (not illustrated) is threaded into the fixed bolt 24, the disc-shaped base 3 and the moving base 7 are tightened and fixed so that a relative rotation therebetween is not allowed when there is no need to adjust the width of the disc-shaped grindstone 1.

Further, in the seventh embodiment, the disc-shaped grindstone 1 has been described in which the fixed inclined surface 18 and the moving inclined surface 19 are provided as the tapered portion. However, the tapered portion of the invention is not limited thereto. For example, a configuration may be employed in which a tapered portion is provided in only one inclined surface of the fixed inclined surface 18 and the moving inclined surface 19 and the other inclined surface is provided with a contact portion contacting the one inclined surface.

Eighth Embodiment

Figure 12:
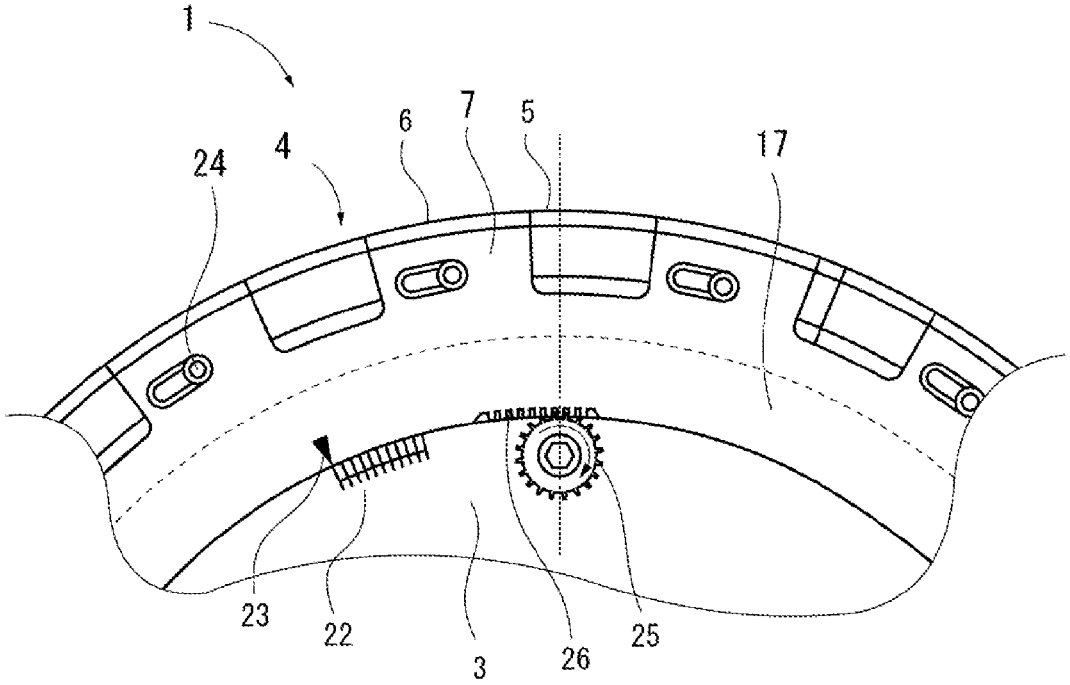
FIG. 12 is a diagram illustrating a disc-shaped grindstone of an eighth embodiment.

As illustrated in FIG. 12, a disc-shaped grindstone 1 of an eighth embodiment has the same configuration as the seventh embodiment except that a gear 25 and a rack 26 engaging with the gear 25 are provided instead of the cam pin 20 and the cam hole 21 of the seventh embodiment. Even by the gear 25 and the rack 26, an annular connection portion 17 and a disc-shaped base 3 may be rotated relatively, and hence the width of the disc-shaped grindstone 1 may be adjusted similarly to the seventh embodiment.

What is claimed is:

1. A disc-shaped grindstone in which a plurality of split grindstones are provided in an outer circumferential surface of a disc-shaped base, wherein the split grindstones include at least one moving grindstone which is movable in an axial direction of the disc-shaped base, wherein a corner portion in the axial direction of each split grindstone is formed in a curved surface shape, wherein at least one split grindstone which is fixed to the disc-shaped base so as not to be movable in the axial direction among the split grindstones is defined as a fixed grindstone, and wherein the moving grindstone and the fixed grindstone are formed so that a curvature radiuses of the corner portions in the axial direction are different from each other.

2. The disc-shaped grindstone according to claim 1, wherein the split grindstones are split in a circumferential direction of the disc-shaped base.

3. The disc-shaped grindstone according to claim 2, wherein a plurality of the moving grindstones are provided so as to be adjacent to each other in the axial direction, and wherein an axial end surface of the moving grindstones is an inclined surface which is inclined in the axial direction of the disc-shaped base.

4. The disc-shaped grindstone according to claim 2, wherein a plurality of the moving grindstones are provided in the circumferential direction, and wherein split surfaces of the moving grindstones are deviated from each other.

5. The disc-shaped grindstone according to claim 2, wherein a plurality of the moving stones are provided, and wherein the moving grindstone is composed of two split grind stones which are split into two parts in the axial direction or three split grindstones which are split into three parts in the axial direction.

6. The disc-shaped grindstone according to claim 1, wherein an adjustment screw is provided so as to adjust a movement amount in the axial direction of the moving grindstone.

7. The disc-shaped grindstone according to claim 1, wherein the split grindstone which is fixed to the disc-shaped base so as not to be movable in the axial direction among the split grindstones is defined as a fixed grindstone, wherein the fixed grindstone has a plate shape, wherein the moving grindstone includes a pair of movable plates which sandwiches the fixed grindstone having a plate-shape in the axial direction, wherein a tapered portion of which a thickness gradually changes in a circumferential direction is provided between the fixed grindstone and the movable plates, and wherein a width in the axial direction of the disc-shaped grindstone is changed in a manner such that the fixed grindstone and the movable plates are rotated relatively so as to change a gap between the pair of movable plates by the tapered portion.

* * * * *